US006121961A

United States Patent [19]

Feldman

[11] Patent Number: 6,121,961

[45] Date of Patent: Sep. 19, 2000

[54] STRING ADDRESSING OF PASSIVE MATRIX DISPLAYS

[76] Inventor: Bernard Feldman, 5 Hangar Way, Watsonville, Calif. 95076

[21] Appl. No.: 09/041,027

[22] Filed: Mar. 12, 1998

Related U.S. Application Data

[63] Continuation-in-part of application No. 08/906,977, Aug. 6, 1997.

[60] Provisional application No. 60/023,479, Aug. 6, 1996.

[51] Int. Cl.[7] ..... G09G 3/36

[52] U.S. Cl. ..... 345/204; 345/100; 345/103; 345/87

[58] Field of Search ..... 345/99, 100, 103, 345/213, 87, 204; 348/790, 792

[56] References Cited

U.S. PATENT DOCUMENTS

| | | | |
|---|---|---|---|
| 4,430,748 | 2/1984 | Tuhro et al. | 382/270 |
| 5,170,155 | 12/1992 | Plus et al. | 345/100 |
| 5,172,105 | 12/1992 | Katakura et al. | 345/97 |
| 5,489,918 | 2/1996 | Mosier | 345/89 |
| 5,508,716 | 4/1996 | Prince et al. | 345/103 |
| 5,596,344 | 1/1997 | Kuwata et al. | 345/103 |
| 5,726,672 | 3/1998 | Hernandez et al. | 345/22 |

*Primary Examiner*—Bipin Shalwala
*Assistant Examiner*—Vincent E. Kovalick
*Attorney, Agent, or Firm*—Oblon, Spivak, McClelland, Maier & Neustadt, P.C.

[57] ABSTRACT

An improved technique for driving matrix displays, and in particular, passive matrix displays including row and column configurations of electro-optical display elements (e.g., liquid crystal, LED, plasma, and Electroluminescent). By storing and analyzing illumination information about display elements prior to excitation, a matrix display is more effectively driven. Also, by using the method, the selection ratio in LCD displays is improved.

16 Claims, 8 Drawing Sheets

$V_{AB}$ = V = APPLIED VOLTAGE.

$V_{AD}$ = U = VOLTAGE ACROSS UNSELECTED COLUMNS OF SELECTED ROW $V_{DE}$ = W = VOLTAGE ACROSS CORRESPONDING UNSELECTED COLUMNS OF UNSELECTED ROWS.

$V_{EB}$ = X = VOLTAGE ACROSS CORRESPONDING SELECTED COLUMNS OF UNSELECTED ROWS,

LOGICAL SWITCH RELATIONSHIP: $R_N = \overline{RT_N}$
$C_N = \overline{CT_N}$

STRING ADDRESSING OF PASSIVE MATRIX DISPLAYS

CROSS-REFERENCE TO CO-PENDING APPLICATIONS

The present application is a continuation-in-part of and related to co-pending application Ser. No. 08/906,977, filed Aug. 6, 1997, which is based on U.S. provisional application Ser. No. 60/023,479, filed Aug. 6, 1996, the contents of both of which are incorporated herein by reference.

BACKGROUND OF THE INVENTION

1. Field of the Invention

The present invention relates to an improved technique for driving matrix displays, and in particular, passive matrix displays including row and column configurations of electro-optical display elements (e.g., liquid crystal, LED, plasma, and Electroluminescent).

2. Discussion of the Background

Matrix displays are addressed by coincident selection of a pixel (picture element) at the intersection of a given row and column. Multiplexing is the term applied to the time division whereby the pixels are excited or driven. Problems arise when driving large matrix displays (e.g., a TV display). With a large display, if the electro-optical display elements are electrically linear, crosstalk (noise in the form of unwanted excitation of unselected pixels) limits the size of the display. If the display elements are non-linear, such as in displays that use a thin film transistor (TFT) switch at the intersection of every row and column, then there are few matrix driving problems caused by crosstalk. However, distributed TFT devices are expensive, and the cost escalates exponentially with the size of the display.

Various techniques have been devised for extending the size of the matrix of linear display elements it is feasible to drive. A tutorial is found in *HANDBOOK OF LIQUID CRYSTAL RESEARCH*, Chapter 11, *Addressing of Passive Matrix, RMS Responding Liquid Crystal Displays,* by Terry Scheffer, pp. 445–471; Edited by: Collings and Patel, Oxford University Press, 1997 (hereinafter Scheffer). The contents of the "HANDBOOK OF LIQUID CRYSTAL RESEARCH" are incorporated herein by reference. This tutorial incorporates 40 references.

U.S. Pat. No. 4,586,039 discloses a method of frame frequency adjustment in response to a voltage detection. The adjustment is made after addressing, involves no storage of illumination data and applies only to AMLCDs, not passive displays.

Likewise, U.S. Pat. No. 4,383,039 describes a method of interaction by the user to access data locations on the display. This patent does not address the efficiency or effectiveness of display addressing.

U.S. Pat. No. 5,508,716 illustrates row pair addressing using randomly changing pairs of rows to rely on some sort of statistical cover-up of the defective pixels in the pairs. The benefits of faster response, higher contrast and a wider viewing angle would accrue to the method of the present invention that selects row-pairs to minimize pixel defects. It does not disclose storage and analysis of the data for row-pairs prior to delayed excitation.

SUMMARY OF THE INVENTION

It is an object of the present invention to address at least one disadvantage of known systems for driving matrix displays.

It is another object of the present invention to provide a passive matrix driving scheme which has a very high signal-to noise (SN) ratio for driving matrix displays of linear elements for display areas at least as large as a TV which utilize low cost integrated drivers and memory.

It is a further object of the present invention to provide a driving scheme applicable to root-mean-square (RMS) responding passive matrix displays such as STN and TN LCDs and bi-stable passive matrix displays.

It is another object of the present invention to utilize STING addressing to improve plural line addressing such that passive matrix displays can be used in LCD and other display applications with advantages that are not attainable by prior art methods.

To achieve the above and other objects, the present invention utilizes principles and techniques whereby a matrix display can be successfully driven, for some display applications, independent of the size of the matrix display. Of course, there are practical limits of equipment, expense, etc., that limit the size of the display, but, for one embodiment of driving a display according to the present invention, the size is not limited by the crosstalk.

The method of matrix addressing is called "STING Addressing" because the principle is similar to that employed to bilk the Bookie in the motion picture "The STING." In that movie a delay was introduced between the finish of the race and the wire transmission of the results to the Bookie. During this delay a bet was placed based on the results of the race. In similar fashion, it is feasible to (1) record the image content of a row, plural rows, frame, or plural frames of data to be presented in a visual display, (2) analyze those aspects that promise to enhance the performance of the display in a high speed digital computer, and (3) modify the delayed action to improve the performance of the display. Even though displays are typically updated in 1/60th of a second, the computer operates in increments of 4–5 nanoseconds. This provides an opportunity to perform intelligent delay (STING) addressing.

BRIEF DESCRIPTION OF THE DRAWINGS

A more complete appreciation of the invention and many of the attendant advantages thereof will become readily apparent to those skilled in the art with reference to the following detailed description, particularly when considered in conjunction with the accompanying drawings, in which.

DESCRIPTION OF THE PREFERRED EMBODIMENTS

Figure 1:
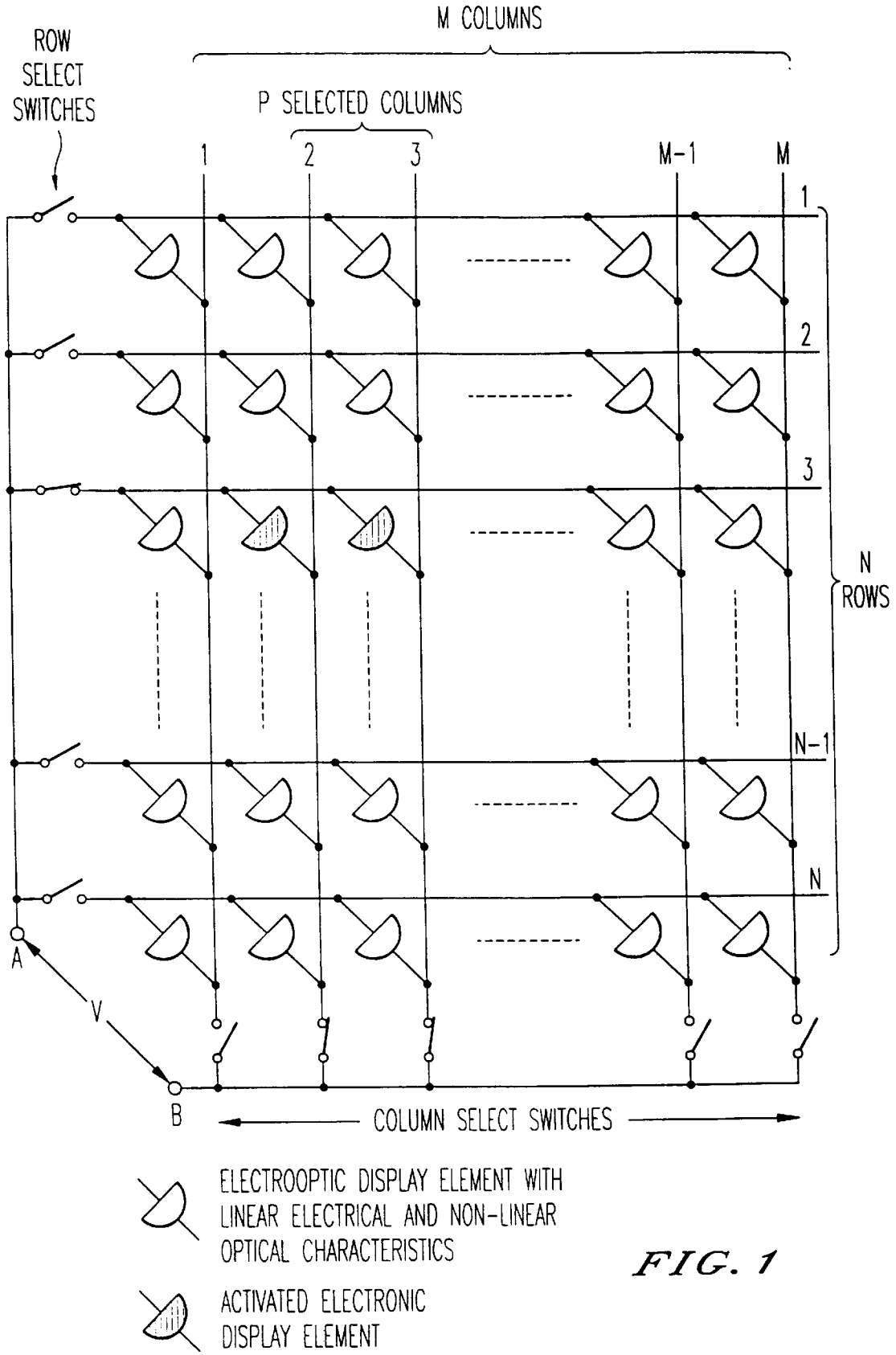
FIG. 1 is a schematic illustration of a matrix of display elements showing an exemplary excitation of one of N rows and two of M columns.

Turning now to the drawings, in which like reference numerals designate identical or corresponding parts throughout the several views, FIG. 1 is a schematic illustration of display elements in an N by M matrix. The present invention includes two principal embodiments. In the first embodiment, a matrix is driven that yields a SN ratio of 3:1 that is independent of the size of the matrix, is inherently AC in nature, requires only the "on" pixel excitation and analyzes one row at a time in a computer to provide the condition for optimum excitation of the display in a delayed (STING) manner. In the second embodiment, a matrix is driven using a root mean square (RMS) responding LCD that involves storing several frames of data, analyzing the properties of the data and utilizing delayed excitation (STING) to improve the overall performance of the display.

Figure 5:
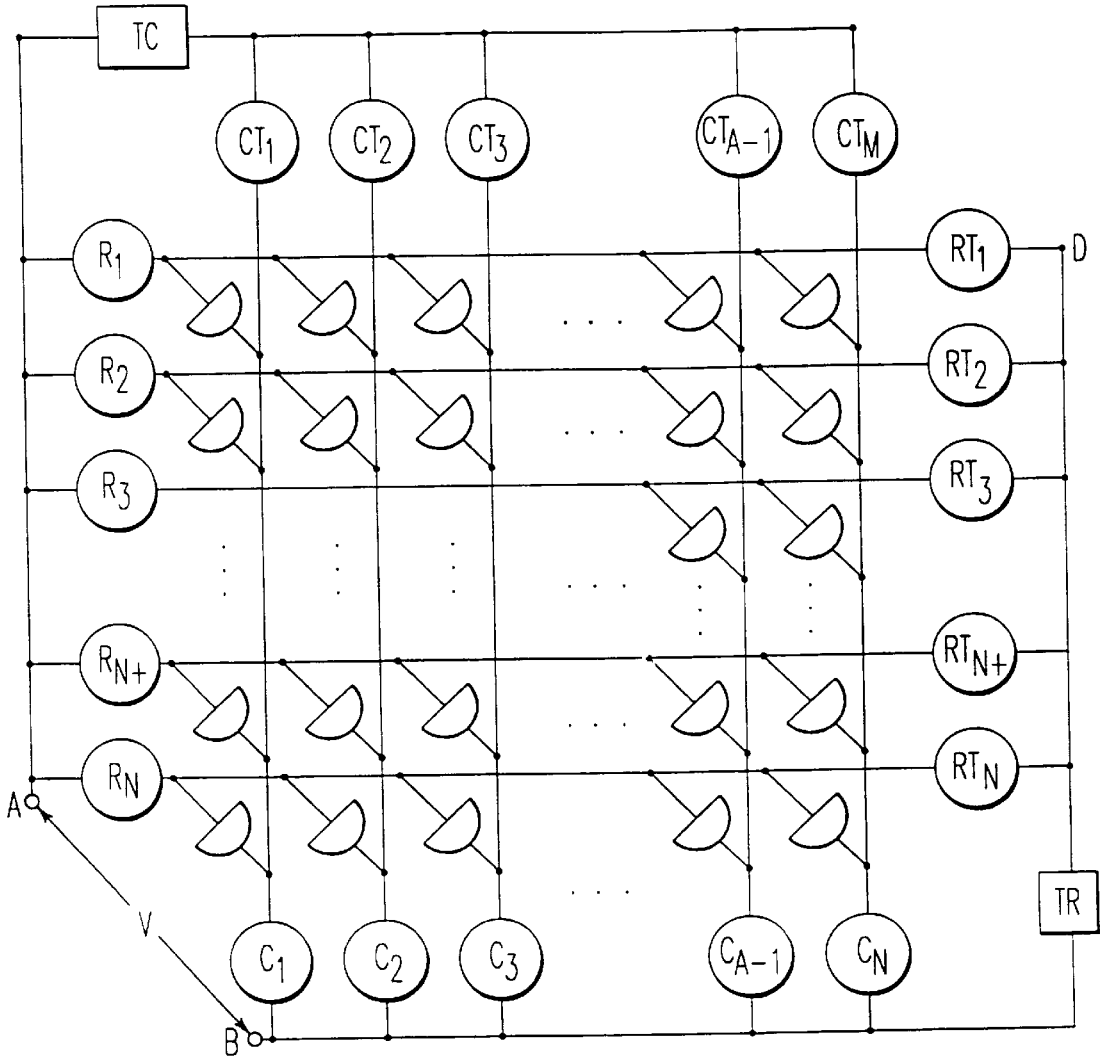
FIG. 5 is a schematic illustration of the driving scheme with appropriate solid state switches for realizing a first embodiment of the present invention.

FIG. 1 depicts the electro-optic display elements as being energized by mechanical switches. This is simply for convenience to specify the crosstalk problem precisely. These switches will be replaced by high speed solid state tri-state switches as shown in FIG. 5. There are N rows of which only one is driven at a time. There are M columns of which $p \leqq M$ are driven simultaneously. Likewise, the display control could be rotated 90 degrees and one column would be driven at a time with multiple rows. The driving voltage, V, needs to be AC for many types of displays to avoid electrolytic decomposition of display materials utilized in display manufacture.

The electro-optic display element is characterized by linear electrical and non-linear optical characteristics. It is assumed, for purposes of this analysis that the impedance, Z, of each element is the same whether it is above or below the threshold for electro-optic response. Although, this is not strictly true, the results still achieve an acceptable SN ratio. For liquid crystal displays (LCDs) the dominating resistive component is unaffected by the optical status of the display. The electro-optical display elements are pictorialized as being bidirectional although their impedances are independent of their directional connection (linear), thus justifying the analytical transformation of the matrix format of FIG. 1 to the schematic of FIG. 2, a transition which is very important to the comprehension of the essence of this embodiment of the invention.

Figure 2:
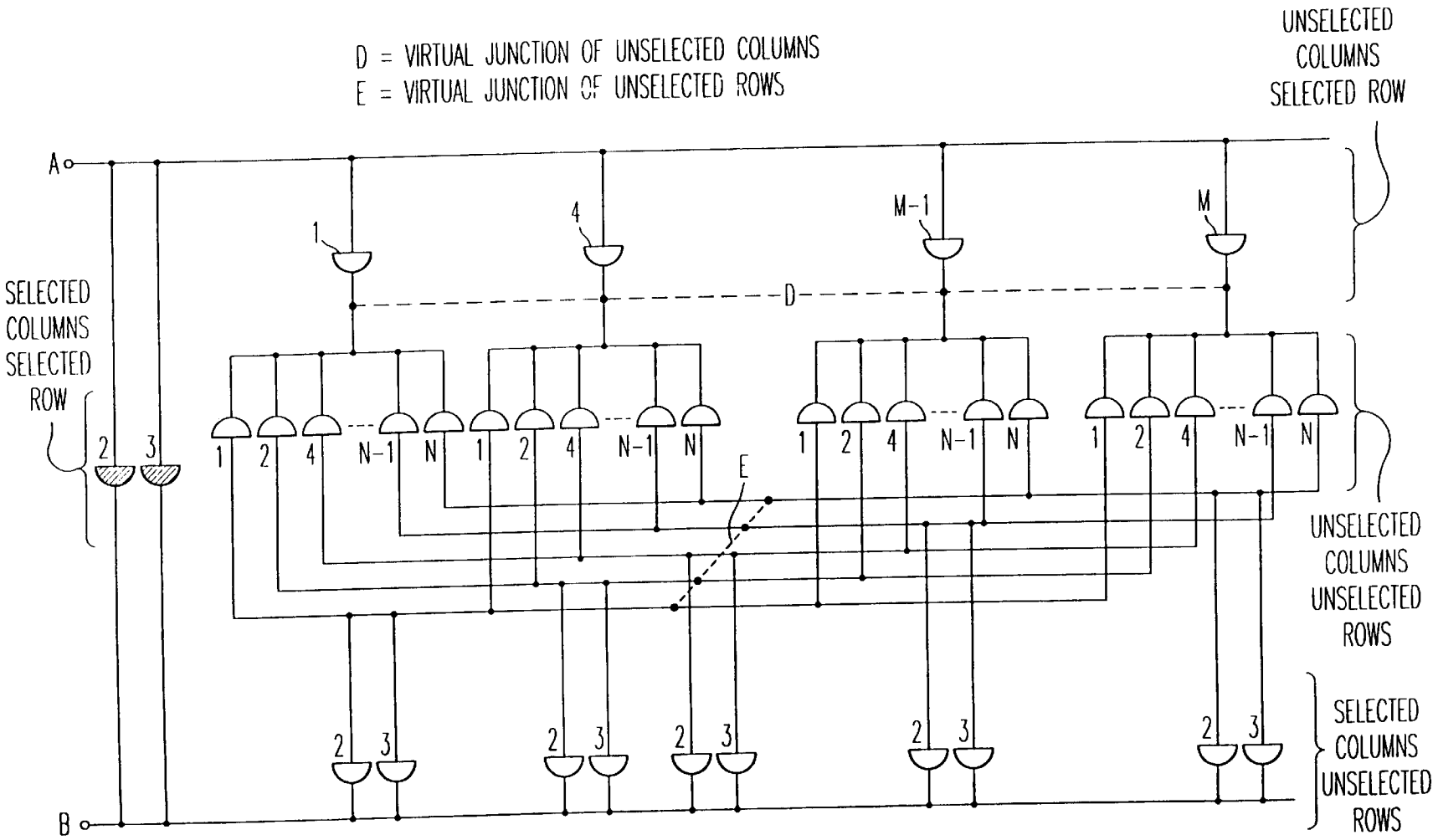
FIG. 2 is a schematic illustration of the matrix of FIG. 1 in a different form to facilitate the description of the crosstalk problem.

If it is assumed that all the elements of the matrix have the same impedances Z, then the rearrangement of the matrix of FIG. 1 into the form as shown in FIG. 2 is valid. Under these circumstances all the ON selected columns are at the same potential and they are depicted in FIG. 2 as forming the virtual junction labeled D. Similarly all unselected rows are equipotential forming the virtual junction labeled E. It will be shown later that these virtual junctions may be physically joined as practiced in this embodiment of the invention, as shown in FIG. 5 for illustrative purposes only.

Figure 3:
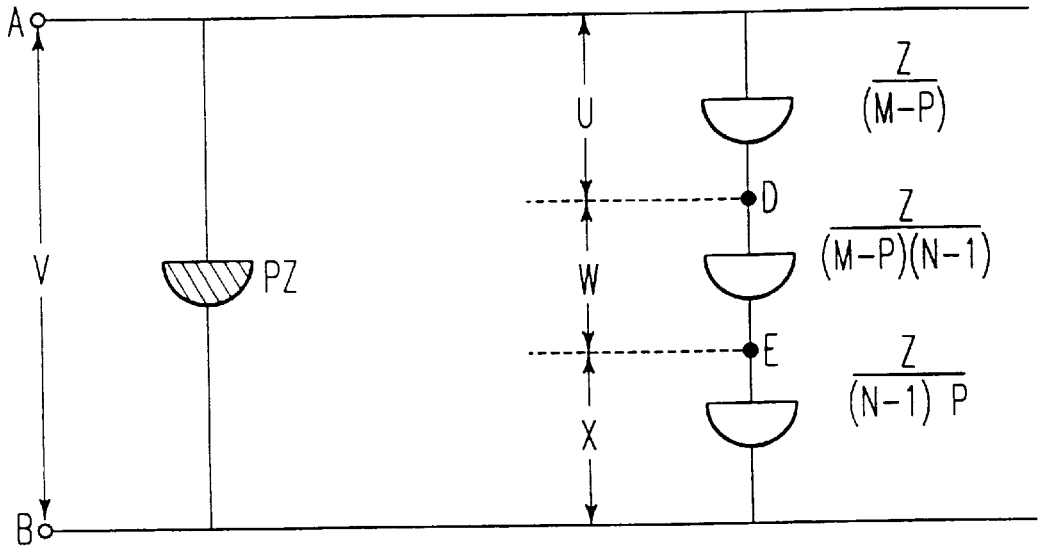
FIG. 3 is a schematic illustration of the simplified and generalized equivalent circuit of a matrix driven a row-at-a-time.

FIG. 3 is a schematic illustration of the simplified and generalized equivalent circuit of the matrix for a given row excitation. In FIG. 3, the relative magnitude of the three crosstalk potentials U, W, X are shown, and what to do about it to optimize the signal-to-noise ratio of a matrix display.

Figure 4:
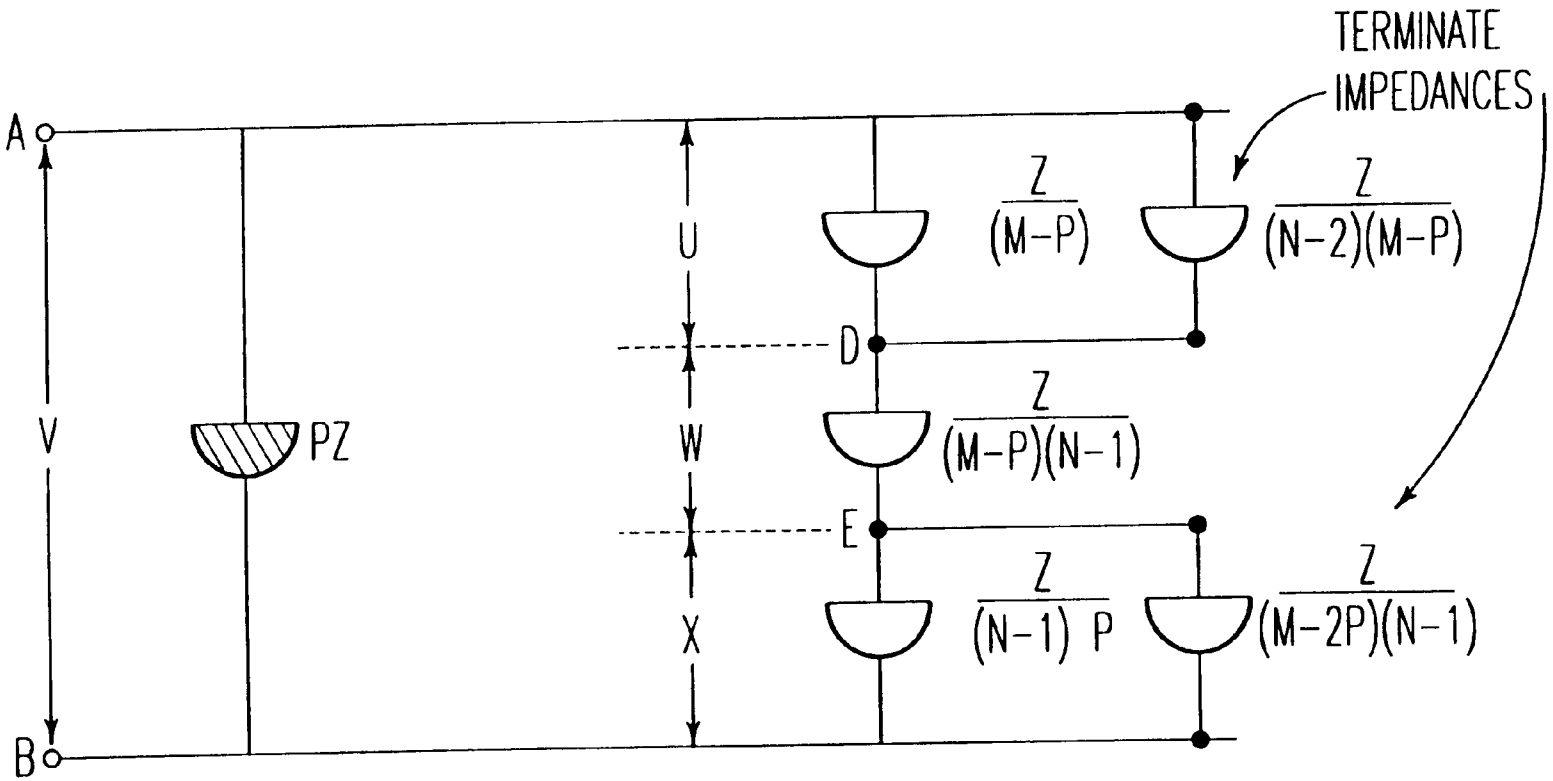
FIG. 4 is a schematic illustration of the circuit of FIG. 3 with terminator impedances such that all crosstalk voltages are equal to one-third of the driving voltage.

As shown in FIG. 4, it is possible to apply terminator impedances of appropriate values to equalize all the crosstalk potentials and thus achieve a SN ratio of 3. The column terminator impedance could be implemented by connecting an impedance equal to Z/(N−2) between A and each column and left floating for selected columns (tri-state switching) and connected to D for unselected columns. However the row terminator impedance value is dependent on the number of columns selected, p, and, moreover, to avoid a negative impedance, p must be limited to M/2 for any given row driven. Therefore these constraints point toward a preference for a single variable impedance terminator for the rows and one for the columns, as illustrated in FIG. 5 by the column terminator, TC and the row terminator, TR.

The terminator impedances TC and TR may be digital assemblies of binary or binary-coded decimal groups of impedances or arrays of display elements or other assemblies devised by those skilled in the art of electronics. Tri-state switches, steered by the appropriate value of p, hook up the correct number of parallel arrays of display elements or impedances to produce the correct and temporal value of terminator impedances for an optimal SN ratio.

One trade-off paid for this optimizing technique is the additional power dissipated in the terminator impedances. In an alternate embodiment, this is mitigated in various ways including not terminating either or both terminators for those cases where the SN ratio is higher than 3:1. For displays that can utilize a 3:1 SN ratio this power penalty is negligible in comparison to the higher voltages utilized in RMS responding LCDs.

Figure 6:
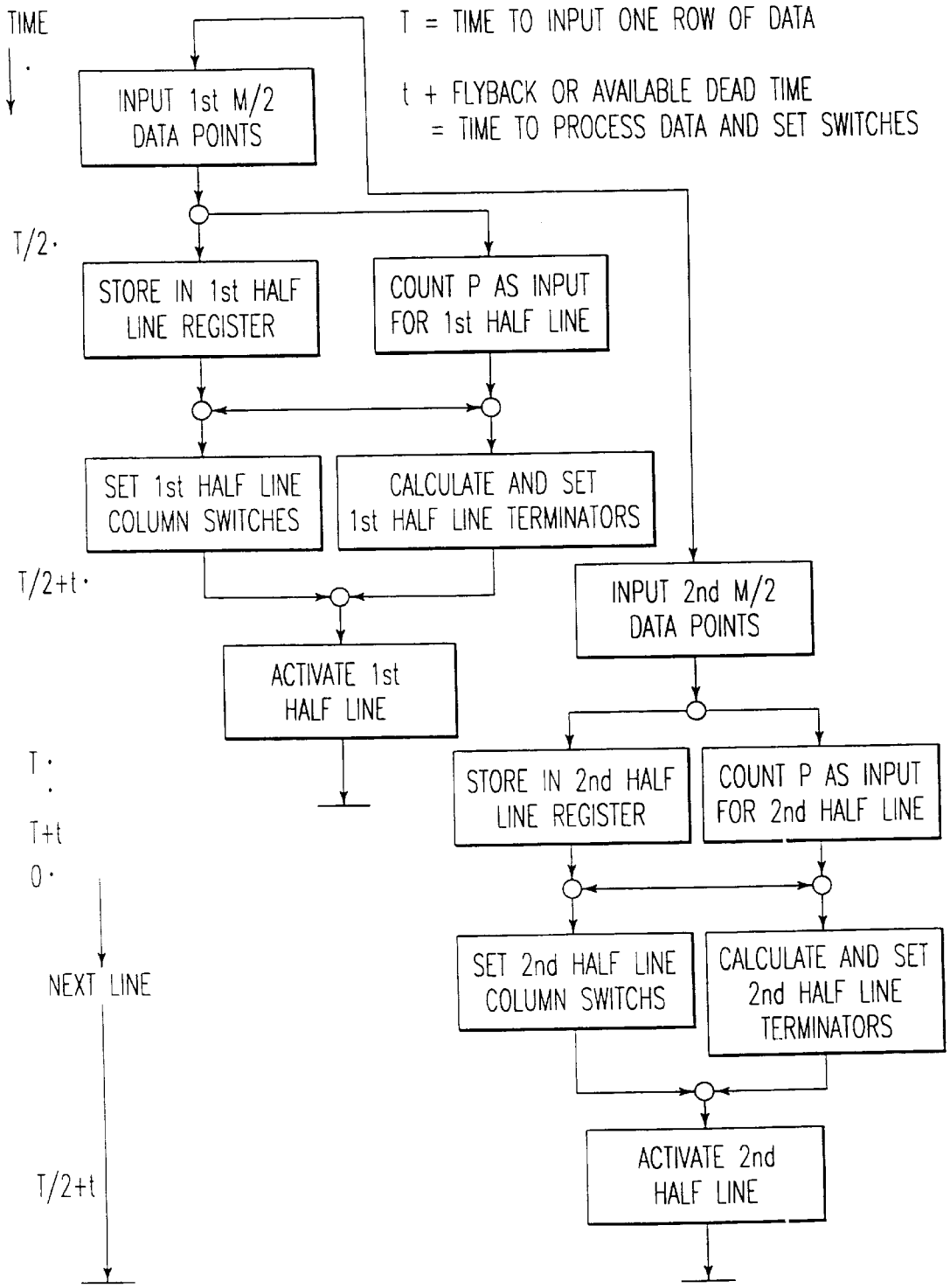
FIG. 6 is a schematic illustration of a flow and time chart of what happens and when while processing one row of data into a matrix.

FIG. 6 is a flow- and time-chart of what happens when processing one row of data in the matrix. The main point to note is that if it takes T seconds to input a line of data and there are t seconds of flyback or dead time available between lines, then the requirement on the speed of the semiconductor processing and switching for optimum performance is the time t. If this condition is met then each half line of data is activated for T/2 seconds.

During the first T/2 seconds the first half line is stored in a serial-to-parallel shift register whose individual outputs set the switches $C_1$ to $C_{M/2}$ of FIG. 5. As the data is entered, the number of "true" or active inputs are counted and output to the CPU as the number of columns, p. The CPU also sets the switches $CT_1$ to $CT_M$ based upon the input information: $C_1$ to $C_{M/2}$. After a time T/2 the same process occurs for the second half-line. T seconds of processing time after T/2 seconds, the first half-line is activated for a time of T/2 seconds. The next line of data then is inputted and during a period of time, T/2+t, the second half of the preceding line is activated.

The foregoing example illustrates the STING method of the present invention for driving an electro-optical display a row at a time at high speed. By using data-specific properties of the row and activating the display one row late, the display optimizes the SN ratio. This embodiment is applicable to displays that are especially sensitive to residual DC and its accompanying potential for electrolytic destruction (e.g., as ferroelectric displays, bistable LCDs, electroluminescent, plasma and distributed LEDs).

However, for RMS voltage responding LCDs a simpler drive scheme that utilizes less hardware and achieves higher SN ratios is conventionally employed. It is a DC scheme which employs polarity reversals to achieve an AC effect. The conditions for an RMS voltage responding display are specified in Scheffer.

Figure 7:
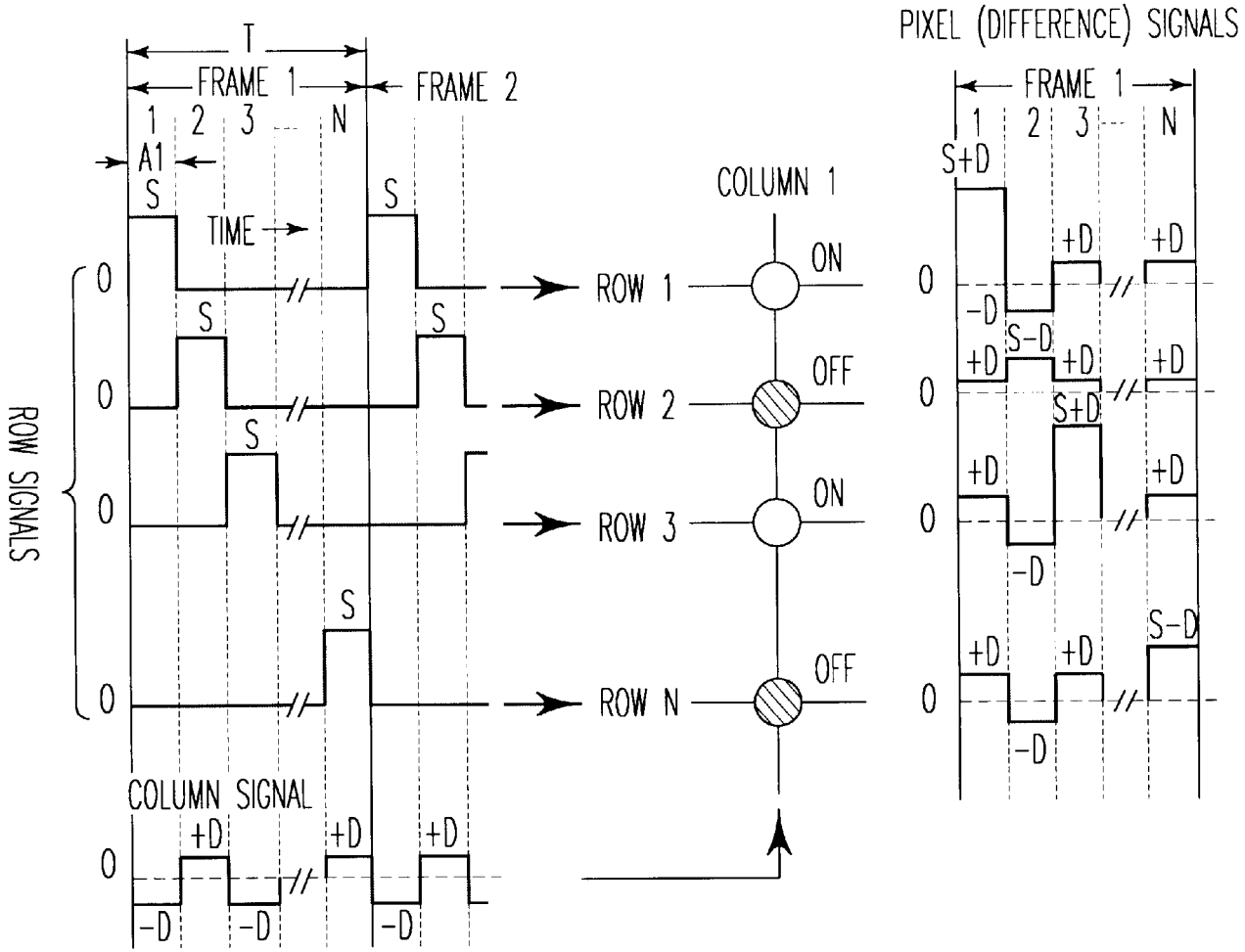
FIG. 7 PRIOR ART
FIG. 7 is a schematic illustration of a conventional selection method for driving passive matrix RMS responding LCDs.

Referring to FIG. 7, which has been taken from Scheffer's Figure 11.4 on page 448, note that the selection voltage, S, is applied to one row at a time while all other rows are tied to 0 volts; the columns, either have −D volts for the "on"

pixels or +D volts for the "off" pixels. Thus the voltage across a given pixel is the difference between the selection voltage, S, and the column voltage (±D). Thus the voltage applied to all "on" pixels in a selected row is S+D and the voltage applied to all "off" pixels in a selected row is S−D. All pixels in the unselected rows experience +D. For S=2D we have the case equivalent to the SN ratio of 3:1 shown in the first embodiment of this invention, except for the need to convert this DC drive into AC, which is accomplished by polarity reversal frame-to-frame and other more refined methods described by Scheffer in section 11.2.2 on p. 450 and by Hotto in U.S. Pat. No. 5,627,558, dated May 6, 1997.

Scheffer explains in section 11.2 that S may be optimized at some voltage above 2D, depending on the number of rows in the display or what is equivalent to the selection time of application of the selection voltage. This driving method bears the name of one pair of its discoverers, Alt and Pleshko (A&P) who proved that for LCDs which respond to the RMS of the applied voltage an on-off voltage ratio greater than 3 could be used to advantage. Scheffer also points out that since all rows and columns are at defined low impedance voltage sources, columns are completely independent of each other so he shows only one column in his Figure 11.4. The same observation can be made about the rows. In the prior art, since the display is addressed in real time, all the column signals for a selected row are presented for that row as that row is selected.

Only one column is shown in FIG. 7 to emphasize the irrelevance of the column signals for the unselected rows (providing of course that they range between +D and −D). This property, applied to the rows, provides the opportunity created by STING addressing to address more than one row at a time as described in the following sections. Scheffer describes how the optimized S is determined in section 11.2.1. What follows is a description of STING addressing as it applies to various versions of A&P driven RMS responding LCDs.

It has been shown in the first embodiment of this invention that the foreknowledge of the contents of a row of data permits the addressing (STING) of a passive matrix display in an advantaged manner. This form of STING addressing is not applicable to RMS responding LCDs. However, since computers are usually associated with LCD displays, computers are capable of rapid analysis, and a frame, or several frames, of data are readily stored at low cost in random access memories (RAMs), the foreknowledge of a frame or frames of data and their analysis can be utilized to significantly improve the presentation of the data after the fact.

STING PLURAL LINE ADDRESSING: SPLA

Scheffer in section 11.2.6.3 describes plural line addressing. He concludes that addressing two lines at a time has some applicability but the resultant vertical resolution distortion of the intended data represents a serious problem for graphical and alphanumeric presentations, the very type encountered in displays for computers. Scheffer also teaches that the limitations of A&P addressing in the light of vast experience and advanced analysis are firm to the point of being characterized as the "iron law" of passive matrix addressing.

An illustrative example is provided below to describe the operation of the present invention. A display with N rows is to be driven using Ne effective lines. A display cycle (cycle) is defined as the frame time divided by Ne. The following steps apply STING addressing to an Ne line implementation of an N row display:

1. Count and store the pixel status (on or off) for each of the N rows.

2. Partition the rows into groups where possible, wherein each group consists of rows with an identical unique pattern. A necessary condition for identical row identification is that each candidate row has the same number of off and on pixels (either state can be counted). Then, compare each group of rows that fulfill the necessary condition for the sufficient condition that all the column pixels' status for the group are the same.

3. Having created Ng groups of rows, with one unique pattern per group and at least two rows per group, then for each unique pattern corresponding to a unique group, the pattern is selected once, counted as 1 of the Ne effective lines of the frame, and every row in the group with that pattern is tagged to be driven in parallel.

4. The system (software program) then determines the number of rows that must be driven in a partition. In the preferred embodiment, a partition is a pair of rows, but the number of rows per partition, Nrpp, may also be three or more. The number of partitions, Np, is given by:

$$Np = \left\lceil \frac{N - Ni - Ne + Ng}{Nrpp - 1} \right\rceil,$$

where Ni is defined as the total number of identical rows in all Ng groups. The system will then determine the Nrpp·Np rows that can be grouped (formed into respective partitions) to give the least error. These Nrpp·Np rows (Np partitions of Nrpp rows each) are driven in Np cycles.

5. The remaining number of rows do not match other rows well and are to be driven singly or individually. This is Ns=N−Ni−Nrpp·Np rows.

6. After the time lapse to accomplish the above 5 steps, the display is activated in accordance with the appropriate parameters for an Ne line display.

It is important to note that in step 4 above, a row can only be used once in the partitions. For example, when pairing rows, i.e., when Nrpp=2, even if a pairing of row 1 and row 2 has the same error value as a pairing of row 2 and row 3, row 2 cannot be used in two different pairs. For example, assume that rows 1–3 are equivalent except as given by:

| | |
|---|---|
| Row 1: | ...001... |
| Row 2: | ...010... |
| Row 3: | ...100.... |

Then, the pairing of rows 1 and 2 is very good since the rows are similar, and the pairing of rows 2 and 3 is just as good. However, once either of the pair 1 and 2 or 2 and 3 is chosen as part of the Np pairs, then other pair cannot be used.

A more concrete example of the above steps is provided. Assuming that N=240, Ne=120, and Nrpp=2, and further assuming that there are 3 rows with pattern 1, 40 rows with pattern 2, 10 rows with pattern 3, and no other rows that match any of patterns 1–3, then Ni=53 and Ng=3. After using (1) one cycle to drive all 3 rows with pattern 1 as one effective line, (2) a second cycle to drive all 40 rows with pattern 2 as a second effective line, and (3) a third cycle to drive all 10 rows with pattern 3 as a third effective line, (120−3=117) effective lines remain to be driven. However, (240−53=187) rows remain. Not all 187 rows can be driven individually in the remaining 117 cycles, so Np=⌈(N−Ni−Ne+Ng)/(Nrpp−1)⌉=⌈(240−53−120+3)/(2−1)⌉=70 pairs of rows must be driven in parallel. The system finds the Nrpp·Np or 140 rows that most closely match, and these rows are paired and driven in Np=70 cycles. Finally, Ns=N−Ni−Nrpp·Np=240−53−2(70)=47 rows are driven singly or individually. The total number of lines driven in the example are Ni in the groups, Nrpp·Np in pairs, and Ns singly. This is Ni+Nrpp·Np+Ns=53+2(70)+47=240, the total number of rows. This process was completed in Ng+Np+Ns=3+70+47=120 cycles, confirming the proper running time of the method.

A second concrete example of the above general steps is provided. Assuming that N=240, Ne=120, and Nrpp=2, and further assuming that there are 3 rows with pattern 1, 40 rows with pattern 2, and no other rows that match either of patterns 1 and 2, then Ni=43 and Ng=2. After using (1) one cycle to drive all 3 rows with pattern 1 as one effective line, and (2) a second cycle to drive all 40 rows with pattern 2 as a second effective line, (120−2=118) effective lines remain to be driven. However, (240−43=197) rows remain. Not all 197 rows can be driven individually in the remaining cycles, so Np=⌈(N−Ni−Ne+Ng)(Nrpp−1)⌉=⌈(240−43−120+2)/(2−1)⌉=79 pairs of rows must be driven in parallel. The system finds the Nrpp·Np or 158 rows that most closely match, and these rows are paired and driven in Np=79 cycles. Finally, Ns=N−Ni−Nrpp·Np=240−43−2(79)=39 rows are driven singly or individually. The total number of lines driven in the example are Ni in the groups, Nrpp·Np in pairs, and Ns singly. This is Ni+Nrpp·Np+Ns=43+2(79)+39=240, the total number of rows. This process was completed in Ng+Np+Ns=2+79+39=120 cycles, confirming the proper running time of the method for a different configuration. The present method also works when the number of effective lines, Ne, is other than 120, such as when Ne=180.

This example algorithm applies to the STING addressing of a display based on the status and analysis of a single frame. For many applications the defects that result from row-pair mismatches will be tolerable so that this simplest and most cost-effective embodiment of the invention will meet the requirements of the application.

However, the acquisition, storage, analysis and delayed activation of Q frames of a super-frame, where Q may represent as many as 32 frames, is feasible. Thirty-two frames of a VGA display would utilize less than 4 megabytes of RAM for storage the more complex software would entail an additional step that would minimize the recurrence of mismatches at the same pixel location from frame-to-frame, thereby enhancing the fidelity of the display.

The object of the system will be to leave compromised pixels almost black or almost white instead of the undesirable gray for either an on or off pixel. The overall result of a system, such as this simplified version, is to minimize the distortions of the presentation to an acceptable level. Many modifications of this teaching may be developed for different applications, but the core of the future of this technology is the STING addressing approach herein delineated. The example algorithm does not address the issue of gray scale or DC bias since conventional methods are applicable to STING addressed displays.

Although the example cited above is posited on the basis of a resultant 120 line display, many applications might be suitably reduced in cost with an effective number of lines somewhere between 120 and 240. Other applications might be tolerant of greater infidelity to the original data such that more than two non-identical rows may be addressed simultaneously (after similar techniques of prior storage and analysis) resulting in less than N/2 (e.g., 120 when N=240) effective lines (rows). That is, by looking for closely matching triple, quadruples, or n-tuples, the system (software program) can drive triples, quadruples, or n-tuples in parallel without greatly degrading the perceived visual clarity, and poorly matched rows can still be driven individually. The reduction to 120 lines results in a 44% tolerance relaxation on the properties of the LCD material, glass flatness, temperature and spacing parameters for a VGA application. Although the example references a VGA application, the benefits of STING addressing are clearly applicable to higher resolution displays. One of the major projected benefits of STING addressing is a significantly lower cost of the LCD. Further, the cited example takes advantage of the fact that the display is associated with a high speed computer that can perform the video tasks which have been set forth for it at the same time that, by multi-tasking, the primary programs are implemented. Alternatively, the analysis can be performed by a dedicated video card which includes a memory for storing frames, statistics and code for a CPU on the video card.

Moreover, although the above description has been made mostly in terms of analysis within a single frame, the analysis of rows and row-n-tuples can also be extended three-dimensionally. That is, the analysis can extend to previous and subsequent frames in a super-frame. Thus, rather than storing a frame, analyzing the frame, and displaying the analyzed frame using the present method, after the first few frames have been stored in the frame buffer, the present invention can begin a more complex analysis of the frames in the frame buffer. The present invention can provide enhanced analysis based on the illumination technique for passive matrix displays. Passive matrix display pixels are only capable of two states: completely on and completely off. However, grayscale images are possible through an addressing trick that makes a pixel appears brighter or darker based on the number of frames in a super-frame in which it is illuminated. (The same technique applies to providing shades of color.) For example, a pixel that is to be illuminated at 50 percent gray is actually turned on and off every other frame to appear gray. Likewise, a twenty-five percent gray pixel is turned on once every four frames and off for the remaining three frames. However, to some extent, the exact order of on and off is not as important as the relative frequency that a pixel is on or off. Thus, the changes in pixel state between frames provides an opportunity to perform data shuffling between frames within the super-frame to provide more closely matching rows. For example, it is possible to have two rows that would otherwise be exactly the same, but they differ in one bit in each of two frames within a superframe. If that bit was changed in each frame to its opposite value, these rows would become equal and could be driven in pairs without error. Table I below shows two rows during frames 1 and 2.

TABLE I

| |
|---|
| Frame 1 |
| Row 1: 0 . . . |
| Row 2: 1 . . . |
| Frame 2 |
| Row 1: 1 . . . |
| Row 2: 0 . . . |

By changing the order of the inconsistent bit between frames 1 and 2, the new row values for the frames become as shown in Table II.

TABLE II

| |
|---|
| Frame 1 |
| Row 1: 0 . . . |
| Row 2: 0 . . . |
| Frame 2 |
| Row 1: 1 . . . |
| Row 2: 1 . . . |

Depending on the amount of time available for analysis, this process may even be extended to non-consecutive frames.

Figure 8:
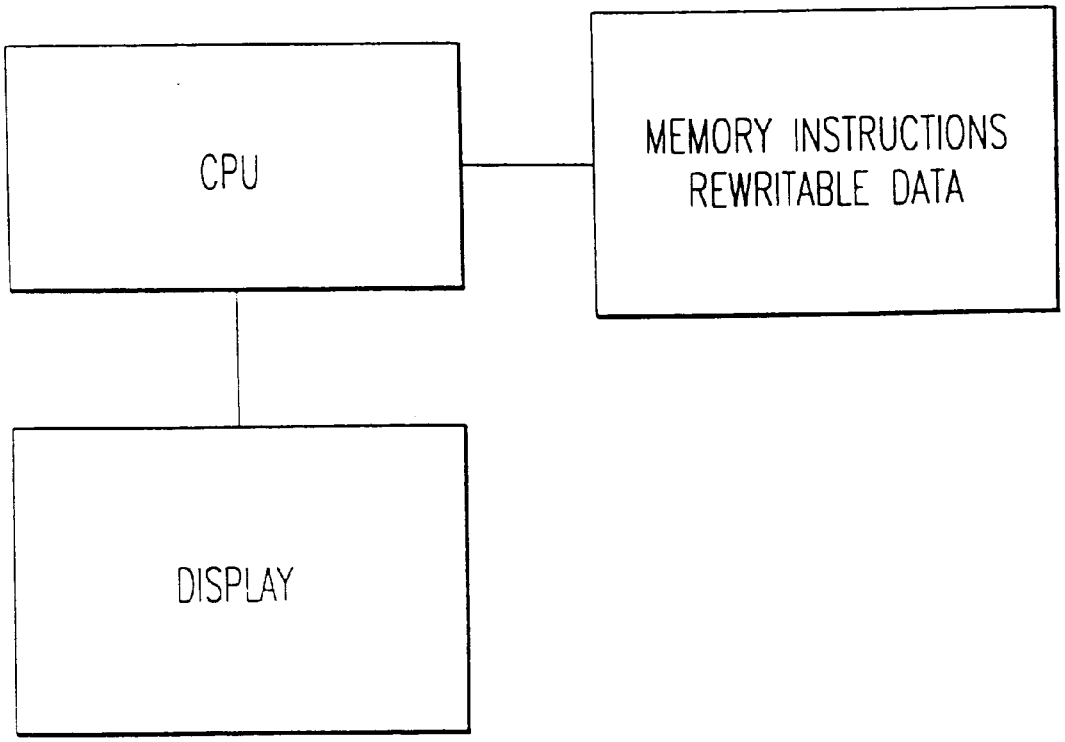
FIG. 8 is a schematic illustration of a controller for driving a matrix display according to the present invention.

FIG. 8 is a schematic illustration of a computer controller according to one embodiment of the present invention. The computer controller includes a central processing unit (CPU) and computer readable storage medium, such as a memory (e.g., ROM, EPROM, EEPROM, Flash memory, static memory, DRAM, SDRAM, and their equivalents), configured to control the CPU to perform the method of the present invention. Likewise, the memory contains rewriteable data for counting/storing the number of "on" elements. The computer controller in an alternate embodiment further includes or exclusively includes a logic device for augmenting or fully implementing the present invention. Such a logic device includes, but is not limited to, an application-specific integrated circuit (ASIC), a field programmable gate array (FPGA), a generic-array of logic (GAL), and their equivalents.

STING Addressing of Bi-Stable or Multi-Stable Passive Matrix Displays

There is also a class of materials that can advantageously be addressed using STING addressing that do not require refreshing each frame. One such material is disclosed in "The transient response and dynamic drive of cholestric liquid crystal displays" by X. Y. Huang, J. W. Doane, and D. K. Yang, published in the Journal of the Society for Information Displays, Vol. 5, number 3, 1997, pgs 179–187, the contents of which are incorporated herein by reference. Once a bi-stable pixel is addressed, it need not be re-addressed or updated each frame. This situation opens up an application for STING addressing incorporating techniques in addition to those cited for the previous embodiments of the present invention.

The principal new technique can be described as follows:

1. After a first frame is addressed and activated, and until such time as the complete matrix needs to be refreshed, a succeeding frame is recorded in a buffer along with the original frame.

2. The two frame buffers are analyzed and a difference frame is established corresponding only to those pixels that need to be changed.

3. The resulting smaller difference frame is addressed, ignoring the pixels that remain unchanged, resulting in a smaller matrix and therefore higher performance and/or the ability to use a material with less restrictive parameters.

4. After the difference frame is addressed, the data from the first frame of the pair is discarded and a subsequent frame of data is considered to construct a succeeding difference frame, and the process repeats.

In addition to the benefits thus derived by the delay of two frames plus analysis time, it should also be noted that the difference frame may be driven a column-at-a-time instead of a row-at-a-time, if it turns out that such a switch in addressing is advantageous. The decision to switch can be made for each and every difference frame. This technique may also be employed for any other type of passive matrix display, but it is not considered as beneficial where the number of columns is much greater than the number of rows.

For bistable LCDs employed in reflective displays, for applications featuring text and graphics especially, the columns may not be longer than the rows all the time, and this feature can be exploited. Also this type of application can advantageously utilize a font in which the space between rows is the same size as the text in the rows. Such a font essentially cuts in half the number of rows with ON pixels. This corresponds to the case for refreshable displays where such a font would increase the number of identical rows. Likewise, using a font with a fixed amount of spacing (OFF pixels) between letters creates empty columns between letters than can be paired in the column-at-a-time addressing mode.

The spirit of this invention extends beyond the examples illustrated for the three principal embodiments. The examples will lead to using STN displays with less critical parameters such as eliminating the need for polished glass and/or permit less expensive TN displays for certain applications. Bi-stable displays can benefit from simpler driving architectures and faster writing. Other applicable properties of STING addressing recognizable by those skilled in the art, should be incorporated into the benefits of STING addressing and covered by the spirit of this invention. The spirit of this invention will lead to other innovations by those skilled in the art that may advance the cause of passive matrix addressing to the point where it will be applicable to desk-top computers at costs that may overcome the cost of replacing the CRT.

What is claimed is:

1. A method of delayed addressing of a matrix of display elements configured in N rows and M columns where the matrix is to be addressed as Ne effective lines, where Ne<N, the method comprising, for each display cycle, the steps of:

a) storing in a first frame buffer an on or off status of each of the display elements for a first frame;

b) partitioning each of the N rows which are identical to a first pattern into a first group;

c) selecting subsequent patterns and partitioning each row, of the N rows, with identical subsequent patterns into corresponding subsequent groups in which each group contains each row, of the N rows, having a corresponding pattern;

d) determining a total number of groups, Ng, of the groups partitioned in steps b) and c), that have more than one row corresponding to one of the unique patterns;

e) determining a number of rows Ni in the Ng groups;

f) driving the Ni rows in Ng cycles;

g) determining a number of partitions, Np, of Nrpp rows each, that are driven in parallel, where Nrpp>1 and Np is given by:

$$Np = \left\lceil \frac{N - Ni - Ne + Ng}{Nrpp - 1} \right\rceil;$$

h) determining Nrpp·Np rows from rows not in the Ng groups whose grouping results in substantially the smallest error;

i) driving the Nrpp·Np rows determined in step h) as Np partitions, of Nrpp rows each, in Np cycles; and j) driving Ns=N−Ni−Nrpp·Np rows not driven in steps f) and i) as Ns effective lines in Ns cycles, wherein each of the Ns rows are driven individually.

2. The method as claimed in claim 1, further comprising the steps of:

k) storing locations of poorly matched rows corresponding to the first frame;

l) storing in a second frame buffer an on or off status of each of the display elements for a second frame; and m) utilizing the stored locations corresponding to the first frame to avoid repeating mismatches in identical locations in the second frame.

3. The method as claimed in claim 1, wherein the number of effective lines, Ne, is N/2 effective lines.

4. The method as claimed in claim 1, wherein the steps b) and c) comprise the sub-steps of:

b1/c1) identifying candidate identical rows by counting a number of on or off pixels in each candidate row; and b2/c2) comparing the M columns of the candidate rows which have an identical number of on or off pixels to determine if a pair of candidate rows is actually identical.

5. The method as claimed in claim 1, further comprising the steps of:

k) storing in a second frame buffer an on or off status of each of the display elements for a second frame; and l) comparing the first and second frames and updating only the rows that have changed between the first and second frames.

6. The method as claimed in claim 1, further comprising the steps of:

k) storing in a second frame buffer an on or off status of each of the display elements for a second frame; and l) comparing the first and second frames and updating only the columns that have changed between the first and second frames.

7. The method as claimed in claim 1, wherein Nrpp=2.

8. The method as claimed in claim 1, further comprising the step of:

k) exchanging a first bit in column Mx, of the M columns, of row Rx, of the N rows, in a first frame of a superframe with a second bit in the column Mx of the row Rx in a second frame of the superframe such that the row Rx can be driven in parallel with another row or with less error in the first and second frames.

9. A computer program product, comprising:

a computer storage medium and a computer program code mechanism embedded in the computer storage medium for causing a computer to address an N row display using a Ne effective lines, where Ne<N, the computer program code mechanism comprising:

a first computer code device configured to store in a first frame buffer an on or off status of each of the display elements for a first frame;

a second computer code device configured to partition each of the N rows which are identical to a first pattern into a first group;

a third computer code device configured to select subsequent patterns and partitioning each row, of the N rows, with identical subsequent patterns into corresponding subsequent groups in which each group contains each row, of the N rows, having a corresponding pattern;

a fourth computer code device configured to determine a total number of groups, Ng, of the groups partitioned using the second and third computer code devices, that have more than one row corresponding to one of the unique patterns;

a fifth computer code device configured to determine a number of rows Ni in the Ng groups;

a sixth computer code device configured to drive the Ni rows in Ng cycles;

a seventh computer code device configured to determine a number of partitions, Np, of Nrpp rows each, that are driven in parallel, where Nrpp>1 and Np is given by:

$$Np = \left\lceil \frac{N - Ni - Ne + Ng}{Nrpp - 1} \right\rceil;$$

an eighth computer code device configure to determine Nrpp·Np rows from rows not in the Ng groups whose grouping results in substantially the smallest error;

a ninth computer code device configured to drive the Nrpp·Np rows determined by the eighth computer code device as Np partitions, of Nrpp rows each, in Np cycles; and a tenth computer code device configured to drive Ns=N−Ni−Nrpp·Np rows not driven by the sixth and ninth computer code devices as Ns effective lines in Ns cycles, wherein each of the Ns rows are driven individually.

10. The computer program product as claimed in claim 9, further comprising:

an eleventh computer code device configured to store locations of poorly matched rows corresponding to the first frame;

a twelfth computer code device configured to store in a second frame buffer an on or off status of each of the display elements for a second frame; and a thirteenth computer code device configured to utilize the stored locations corresponding to the first frame to avoid repeating mismatches in identical locations in the second frame.

11. The computer program product as claimed in claim 9, wherein the number of effective lines, Ne, is N/2 effective lines.

12. The computer program product as claimed in claim 9, wherein the second and third computer code devices comprise:

an eleventh computer code device configured to identify candidate identical rows by counting a number of on or off pixels in each candidate row; and a twelfth computer code device configured to compare the M columns of the candidate rows which have an identical number of on or off pixels to determine if a pair of candidate rows is actually identical.

13. The computer program product as claimed in claim 9, further comprising:

an eleventh computer code device configured to store in a second frame buffer an on or off status of each of the display elements for a second frame; and a twelfth computer code device configured to compare the first and second frames and updating only the rows that have changed between the first and second frames.

14. The computer program product as claimed in claim 9, further comprising:

an eleventh computer code device configured to store in a second frame buffer an on or off status of each of the display elements for a second frame; and a twelfth computer code device configured to compare the first and second frames and updating only the columns that have changed between the first and second frames.

15. The computer program product as claimed in claim 9, wherein Nrpp=2.

16. The computer program product as claimed in claim 9, further comprising:

an eleventh computer code device configured to exchange a first bit in column Mx, of the M columns, of row Rx, of the N rows, in a first frame of a superframe with a second bit in the column Mx of the row Rx in a second frame of the superframe such that the row Rx can be driven in parallel with another row or with less error in the first and second frames.

* * * * *

UNITED STATES PATENT AND TRADEMARK OFFICE

CERTIFICATE OF CORRECTION

PATENT NO. : 6,121,961
DATED : September 19, 2000
INVENTOR(S) : Bernard Feldman

It is certified that error appears in the above-identified patent and that said Letters Patent is hereby corrected as shown below:

On the Title page, Item [54], and Column 1, the Title is incorrect. The Title should read as follows:

--[54] STING ADDRESSING OF PASSIVE MATRIX DISPLAYS--

Signed and Sealed this

Twelfth Day of June, 2001

Nicholas P. Godici

*Attest:*

*Attesting Officer*

NICHOLAS P. GODICI
*Acting Director of the United States Patent and Trademark Office*